US005997213A

United States Patent [19]

Dennis et al.

[11] Patent Number: 5,997,213

[45] Date of Patent: Dec. 7, 1999

[54] DITCH CHECK

[76] Inventors: Gordon Dennis, 7317 - 156 Street, Edmonton, Alberta, Canada, T5R 1X4; Gilbert Barber, 27332-A Township Rd., Stony Plain, Alberta, Canada, T7Z 1Z6

[21] Appl. No.: 09/131,199

[22] Filed: Aug. 7, 1998

[51] Int. Cl.[6] ..... F02B 7/04

[52] U.S. Cl. ..... 405/114; 405/107; 405/90; 405/15; 81/44

[58] Field of Search ..... 405/87, 91, 114, 405/116, 52, 15, 16, 107; 81/44

[56] References Cited

U.S. PATENT DOCUMENTS 1,645,913 10/1927 McCandless ..... 405/90
1,852,268 4/1932 Schmidt ..... 405/15
4,511,286 4/1985 Hardacre ..... 405/91
5,439,316 8/1995 Richardson ..... 405/91

*Primary Examiner*—William Neuder
*Assistant Examiner*—Frederick L Lagman
*Attorney, Agent, or Firm*—Terry M Gernstein

[57] ABSTRACT

A ditch check includes a plurality of bodies that are located in two rows with a gap defined between the two rows. An M-shaped anchor has two legs and a central section, with one of the legs being located adjacent to one face of a body in one row and the other leg being located adjacent to one face of a body in the other row, and a central section that is located between the two bodies. Each row can include a plurality of end-to-end bodies which can be in overlapping relationship with each other. A tool for placing the M-shaped anchor into the ground is also disclosed.

13 Claims, 4 Drawing Sheets

DITCH CHECK

TECHNICAL FIELD OF THE INVENTION

The present invention relates to the general art of dams and water and erosion control, and to the particular field of barriers used in ditches or swales to control water and/or sediment flow in the ditch.

BACKGROUND OF THE INVENTION

Many construction projects require a ditch or swale. As is well known, these ditches are often required to contain water runoff. This run-off often carries sediment or the like which must be controlled.

Accordingly, the art contains several inventions intended to control such sediment and erosion associated therewith. Examples of such inventions include hay bales, rock ditch checks, and fences. The fences include end-adjacent panels which, in some forms, are anchored to the ground in the ditch by stakes, and in other forms are anchored to the ground by burying part of the panel.

While somewhat successful, these prior art ditch checks have several drawbacks. For example, some of the prior art ditch checks include panels which are difficult to store, transport and set up because they are bulky and must be precisely manipulated and set up. Some of the prior art ditch checks require high maintenance and are thus costly.

Therefore, there is need for a ditch check that is easily and efficiently stored, transported and set up and requires only a minimum amount of maintenance.

Further, since not all terrain is even, a ditch check should be amenable to being efficiently customized for a particular terrain. Many prior art ditch checks include stiff panels that are not at all amenable to such customizing to accurately fit a particular terrain. This may lead to costly construction efforts.

Therefore, there is a need for a ditch check that can be efficiently customized to fit the particular terrain.

Yet another drawback to many know ditch checks is the inability to aid revegitation. A monolithic concrete panel is an example of such a prior art ditch check that makes revegitation difficult.

Therefore, there is need for a ditch check that can promote revegitation.

Since it is difficult to accurately predict the amount of water that will be flowing through a ditch, a ditch check should be amenable to accommodating a wide range of water flow rates. However, many prior art ditch checks have fixed openings which can not accommodate flow rates above a limited velocity. Simply making flow paths through the ditch check larger is not the answer since larger openings will not trap the sediment required for the ditch check.

Therefore, there is need for a ditch check that can efficiently accommodate a large range of flow rates while still trapping the sediment required for the ditch check.

Still further, the flow paths through many of the prior art ditch checks are easily clogged but difficult to clean. A flow passage through a concrete panel can become plugged and may be difficult to clean.

Therefore, there is need for a ditch check that can be efficiently cleaned.

For a variety of reasons, including some of the above-discussed drawbacks, many prior art ditch checks are not reusable. Thus, once set up, such ditch checks must be discarded when their usefulness has expired. This is not as economical as could be desired.

Therefore, there is need for a ditch check that can be reused.

Still further, some ditch checks have portions thereof that dislodge and/or wash away. When flowing water hits a check, it creates an eddy. The eddy scours the soil immediately upstream from the erosion control device which then undercuts the elements associated with the erosion control device, allowing he water to flow beneath the check. The flowing water can also remove the earth holding elements supporting the ditch check thereby creating a possibility of dislodging the entire device.

Therefore, there is a need for a ditch check that is not unduly subject to water bypassing the check or dislodging support elements of the check.

OBJECTS OF THE INVENTION

It is a main object of the present invention to provide a ditch check that is easily and efficiently stored, transported and set up and requires only a minimum amount of maintenance.

It is another object of the present invention to provide a ditch check that can be efficiently customized to fit the particular terrain.

It is another object of the present invention to provide a ditch check that can promote revegitation.

It is another object of the present invention to provide a ditch check that can efficiently accommodate a large range of flow rates and will dissipate water flow energy.

It is another object of the present invention to provide a ditch check that can be efficiently cleaned.

It is another object of the present invention to provide a ditch check that can be re-used.

It is another object of the present invention to provide a ditch check that captures water and does not let that water bypass the ditch check.

It is another object of the present invention to provide a ditch check that reduces the possibility that water will remove the earth supporting the elements supporting the ditch check.

SUMMARY OF THE INVENTION

These, and other, objects are achieved by a ditch check that includes two bodies that are in face-to-face spaced relationship with each other and an M-shaped anchor means that has two legs each of which extends along one face of each body and a central section located between the two bodies.

A water-permeable cover can be supported on each of the bodies and can have the permeability thereof adjusted as required for the particular application. The bodies are flexible and thus can be easily and efficiently stored, transported and set up. The bodies are made of material that is easily maintained and which can be shaped to fit the particular application whereby the ditch check is easily and efficiently customized to the particular application.

The spacing between the bodies permits revegitation as well as makes maintenance efficient. The flow openings through the ditch check can be varied by placing various covers on the bodies.

Due to the ease of placement and removal of the bodies and the anchor means of the present invention, as well as its efficient storage and transport and its ability to be customized for a particular application, the ditch check of the present invention is a significant improvement over prior art ditch checks.

A tool for placing the support elements of the ditch check is also disclosed.

BRIEF DESCRIPTION OF THE DRAWING FIGURES

Other objects, features and advantages of the invention will become apparent from a consideration of the following detailed description and the accompanying drawings.

DETAILED DESCRIPTION OF THE PREFERRED EMBODIMENT OF THE INVENTION

Figure 1:
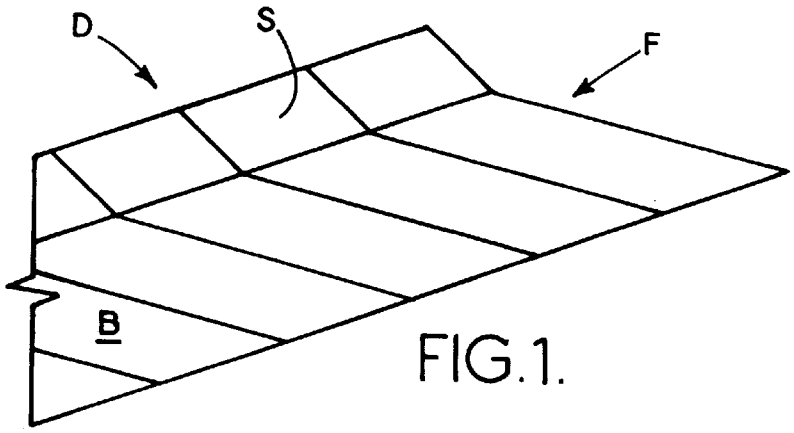
FIG. 1 shows a ditch or swale according to the definition thereof as used herein and which will carry water and/or sediment.

Shown in FIG. 1 is a ditch or swale D through which water flows in direction F. Ditch D has a bottom B located between sloped sides, such as side S. Those skilled in the art will understand that the shape of ditch D may not be as regular as shown in FIG. 1, and that flow rates may vary with the amount of water and sediment being in a wide range. Therefore, any ditch check used in such ditches should be amenable to efficient use, set up and should be amenable to being customized for the most efficient use. Maintenance and re-vegetation should also be as efficient as possible. The ditch check of the present invention fulfills these requirements.

As shown in FIGS. 2–6, a panel ditch check 10 embodying the present invention is adapted for installation in ditch or swale D. Panel ditch check 10 comprises a plurality of bodies, such as bodies 12 and 14. Each body has two ends 16 and 18, a top 20, a bottom 22, a front face 24 and a rear face 26. A water-permeable cover 28 may be used and is located on front face 24 of each body 12 and 14. The cover on one body can be different from the cover on the other body so the overall water permeability of ditch check 10 can be adjusted as necessary to accommodate the range of flow rates expected in ditch D. Each cover 28 has one portion 30 located adjacent to bottom 22 of the body associated therewith. The one portion 30 extends away from the associated body to form a foot portion of the cover.

As discussed above, some prior art ditch checks are susceptible to being dislodged or washed away by water flowing against the ditch check. The geotextile mats force water over the top of the blanket and, when an eddy is created, immediately above the ditch check, the blanket prevents any erosion of the earth. Thus, the blankets prevent any erosion of the earth and the dislodging of the support elements associated with the ditch check of the present invention. In the preferred embodiment of the present invention, the erosion matting 31 and 32 is produced under the trademark GEOJUTE® High velocity biodegradable jute, has a grab tensile (dry) Warp of 4.003 KN, Fill: 0.979 kN; with a high velocity Flow of 6.096 meters/sec, a velocity shear of 0.1379 KPa@ flow rate and a Mannings N of 0.0246.

Figure 2:
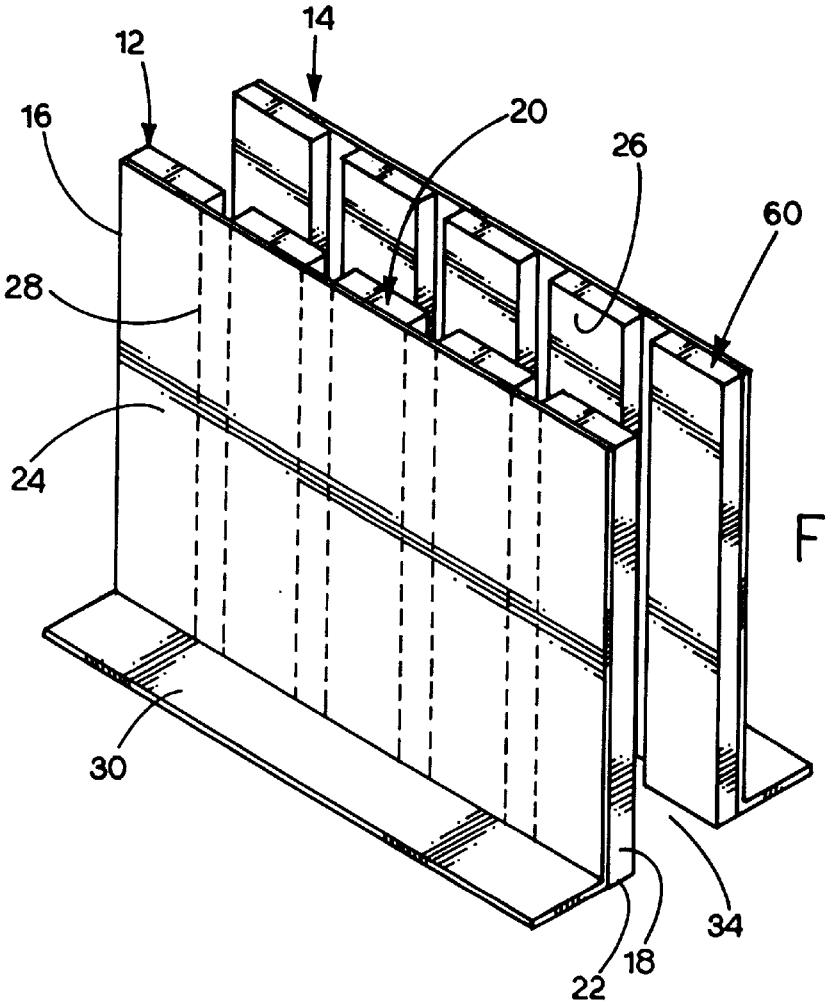
FIG. 2 is an end and top perspective view of two bodies used in the ditch check of the present invention.
Figure 6:
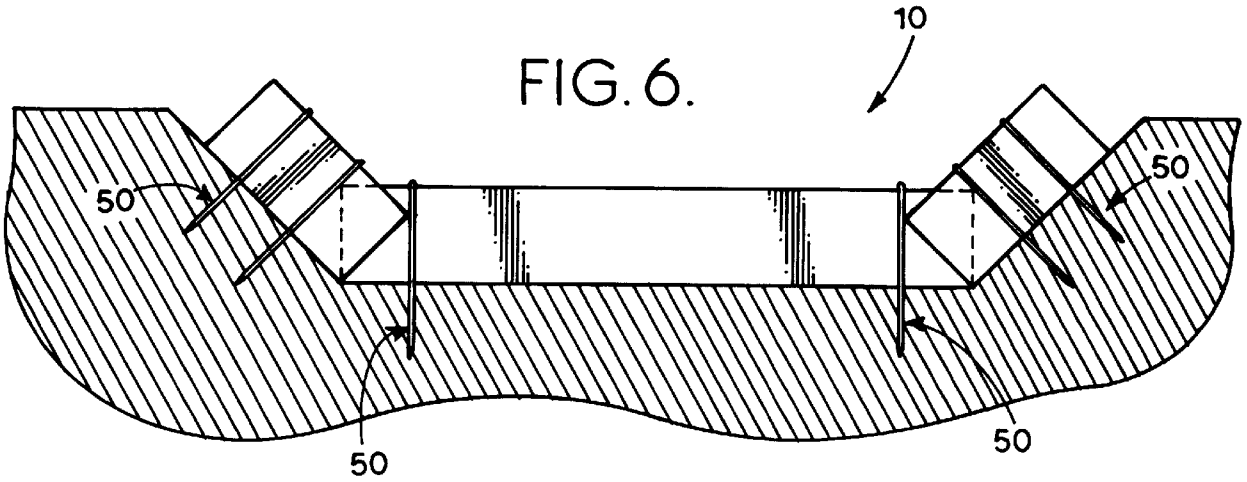
FIG. 6 is an elevational view of a ditch check embodying the present invention in place in a ditch such as shown in FIG. 1.

As can be understood from FIGS. 2 and 6, the bodies of ditch check 10 are arranged in end-to-end adjacency in two rows, with bodies in one row having the ends thereof, such as end 16 of one body overlapping the end, such as end 18 of the adjacent body in the row. The bodies in one row are located adjacent to corresponding bodies in the other row in back-to-back spaced relationship such as shown in FIG. 2. A gap 34 is defined between two such rows.

Figure 5:
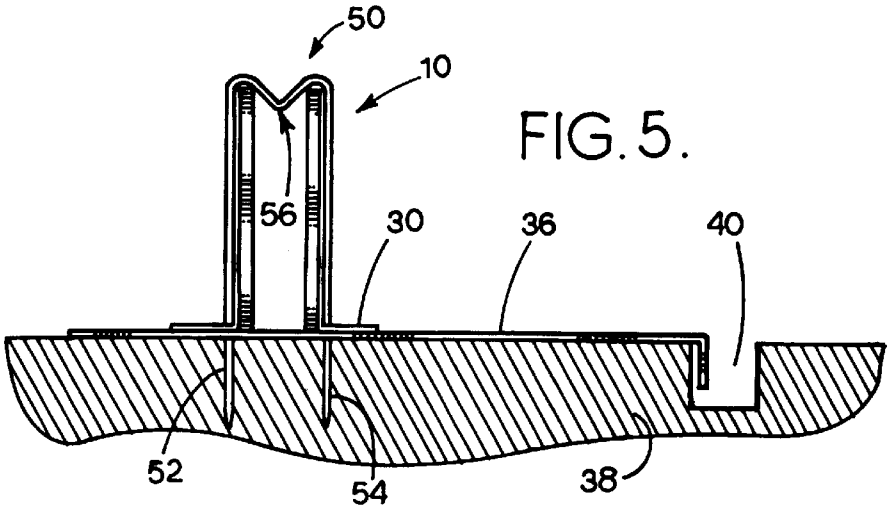
FIG. 5 is an elevational view of two bodies anchored in place on an erosion blanket with a trench positioned adjacent to one of the bodies.

An erosion control blanket 36 is shown in FIG. 5 as being located beneath the bodies, and staple means, such as staples 38, anchor erosion control blanket 36 to the ground.

As is also shown in FIG. 5, a trench 40 is positioned upstream adjacent to the bodies in one row, and erosion control blanket 36 extends into trench 40.

Figure 4:
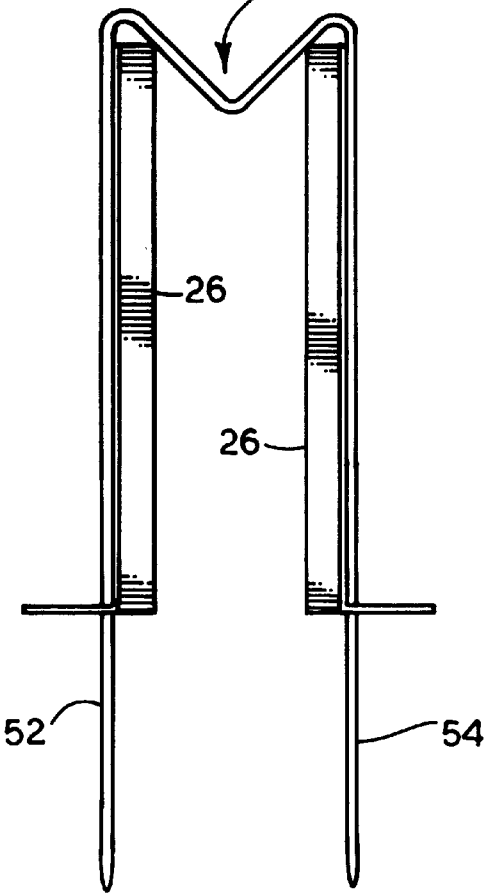
FIG. 4 is an end elevational view of two bodies of the ditch check of the present invention anchored in place by the anchor means shown in FIG. 3.
Figure 3:
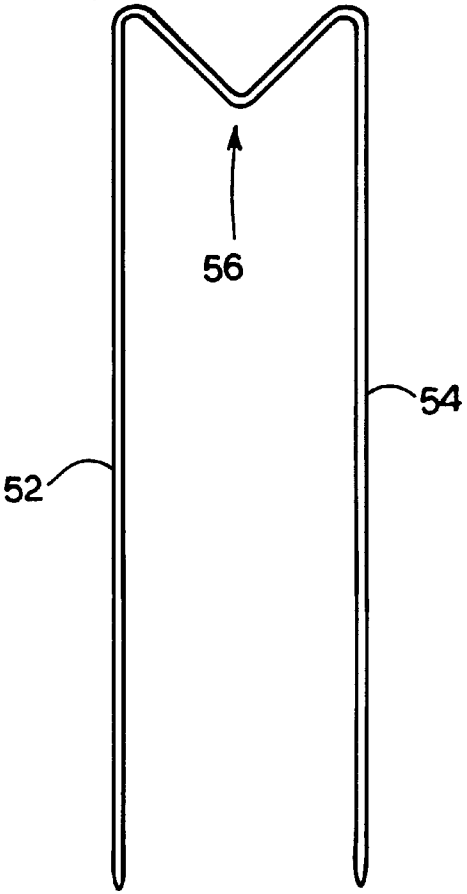
FIG. 3 is an elevational view of an M-shaped anchor means used to anchor the bodies of the ditch check to the ground.

As shown in FIGS. 4, 5 and 6, an M-shaped anchor means 50 anchors bodies 12 and 14 to the ground in ditch D. As is best shown in FIG. 3, anchor means 50 includes two legs 52 and 54 and a central section 56. As can be seen in FIG. 4, in the set up condition, each leg 52 and 54 is located adjacent to the front face of one body and extends through the one portion 30 located adjacent to the bottom of the body. The anchor legs extend into the ground as shown in FIG. 4. Central section 56 is positioned between the bodies and is located adjacent to the rear faces 26 of the bodies.

The M-shaped pin holds the vertical aspects of the ditch check by firmly gripping the top edge and also sets the spacing. In the preferred form of the invention, the M-shaped pin is a Deformed D3.5 rod with a diameter of 6.5 mm, a tensile strength of 550 MPa and a grade of C1008.

As can be seen in FIG. 6, the bodies of ditch check 10 can be arranged to match the particular terrain of the ditch whereby the ditch check can be customized for the particular application. Each body includes a plurality of slats, such as slat 60 shown in FIG. 2. This makes the overall body, such as body 12, quite flexible and amenable to modification for a particular terrain. The slats are formed of material that is easily reused, such as plastics-type material whereby a single ditch check can be used a number of times and is easily cleaned and maintained.

Figure 7:
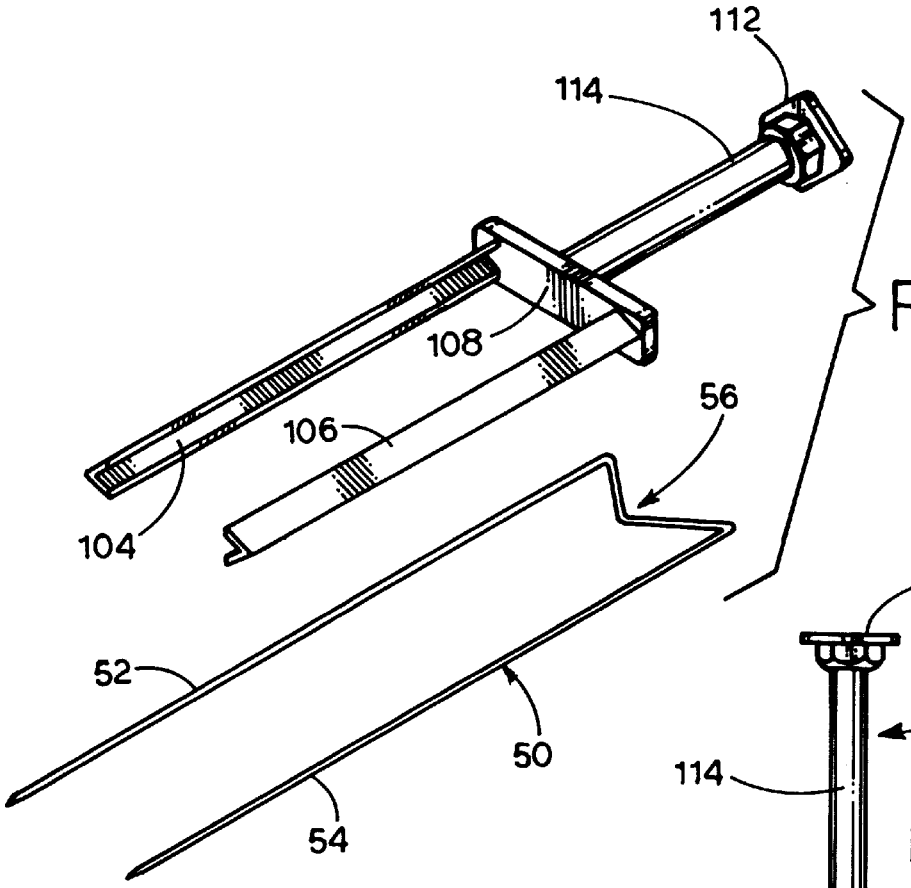
FIG. 7 shows a tool for placing an M-shaped anchor next to such an anchor.
Figure 8:
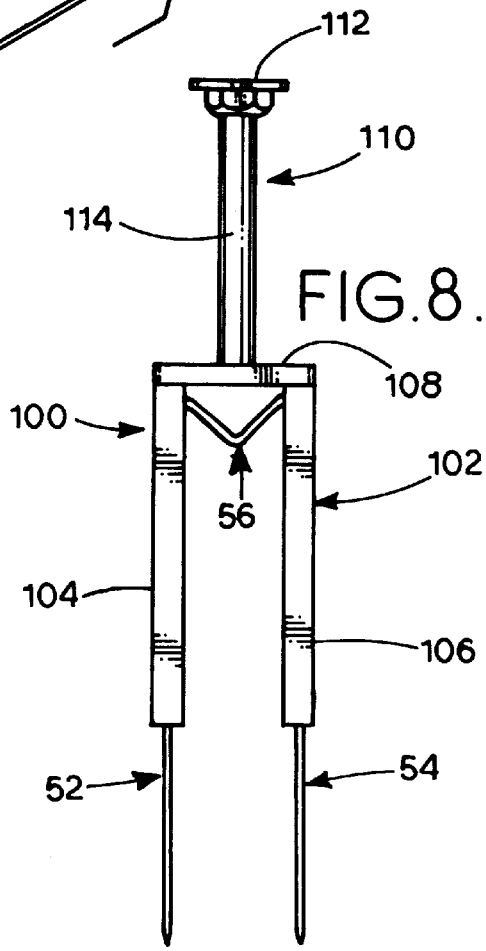
FIG. 8 shows the tool in place on the M-shaped anchor.

A tool 100 is shown in FIGS. 7 and 8 and grips the M-shaped anchor for easy and accurate installation. Tool 100 includes a U-shaped body 102 having V-shaped legs 104 and 106 that accommodate the M-shaped anchor and a bight section 108 connecting legs 104 and 106 together. A driver section 110 is located on bight section 108 and has a driver head 112 on a top end thereof and a body section 114 connecting head 112 to bight section 108 whereby impacts delivered to head 112 are transferred to legs 104 and 106 via bight section 108 to drive the M-shaped anchor into the ground.

By way of illustration, an installation process will be described, it being understood that this description is for illustrative purposes only and is not intended to be limiting.

1. Panel spacing: 30/slope %;

2. Starting at the top of a channel, mark each ditch check site with a stake;

3. Lay an erosion mat strip across the ditch at each ditch check site. The mat should extend up the sideslope and the backslope the length of the panel.

4. Trench in the upstream edge of the mat about 5 cm deep. Staple the mat in the trench with 20 cm staples, placed about 30 cm apart. Manually backfill and compact the trench.

5. Staple the other edge of the mat to the ground with 20 cm staple, approximately 30 cm apart.

6. Starting at either the toe of the backslope or sideslope, place the panel strips on the bottom of the ditch along the center of the erosion mat.

7. Put an M anchor in the installation tool, place the pin over the panels about half way down the strips (in the middle), so a pin leg is against the outside of each panel, and drive the pin through the panel lips into the ground. The panels should be wedged into the M pins at the top. Pull the installation tool off the installed pin.

8. From the installed panel, extend a second pair of panels, overlapping the first panels at the toe, up the side of the backslope. Place the next M anchor pin over both sets of panels at the toe, and drive the pin into the ground with the installation tool.

9. Install the next pins in the middle and at the upper end of the second set of panels, again using both the spacing strip and the driving tool.

10. A third set is placed, extending across the ditch from the first installed panels, overlapping a minimum of 5 cm, and the next pin placed at the overlap.

11. This sequence is continued until the ditch check is installed. The last panel installed is the one extending up the opposite slope from the starting panels.

It is understood that while certain forms of the present invention have been illustrated and described herein, it is not to be limited to the specific forms or arrangements of parts described and shown.

What is claimed is:

1. A ditch check for installation in a ditch or swale that occasionally carries water therethrough, the ditch check comprising:

two bodies, each body having a front face and a rear face, said bodies being located adjacent to each other in back-to-back spaced relationship; and anchor means for anchoring said bodies to the ground in a ditch or swale and including two legs and a central section, each leg being located adjacent to the front face of one body and extending into the ground and said central section being positioned between the bodies and located adjacent to the rear faces of the bodies.

2. The ditch check defined in claim 1 wherein said anchor means is M-shaped.

3. The ditch check defined in claim 2 further including a water-permeable cover on the front face of each body.

4. The ditch check defined in claim 2 wherein each of said covers has a portion that extends away from the front face of the body associated with the cover, the legs of said anchor means extending through said portions.

5. The ditch check defined in claim 2 wherein each body includes a plurality of slats.

6. The ditch check defined in claim 2 further including a plurality of additional bodies located in end-to-end adjacent relationship with each other and with said two bodies.

7. The ditch check defined in claim 6 wherein end-to-end adjacent bodies overlap each other.

8. The ditch check defined in claim 6 further including an erosion control blanket and staple means for anchoring said erosion control blanket to the ground.

9. The ditch check defined in claim 8 further including a trench positioned adjacent to one of said two bodies.

10. A ditch check for installation in a ditch or swale that occasionally carries water therethrough, the ditch check comprising:

a plurality of bodies, each body having two ends, a top, a bottom, a front face and a rear face, said bodies being arranged in end-to-end adjacency in two rows, with bodies in one row having the ends thereof overlapping the ends of adjacent bodies in the row and being located adjacent to corresponding bodies in the other row in back-to-back spaced relationship with a gap being defined between said two rows;

an erosion control blanket located beneath the bodies;

staple means for anchoring the erosion control blanket to the ground;

a trench positioned adjacent to the bodies in one row, with the erosion control blanket extending into said trench; and an M-shaped anchor means for anchoring said bodies to the ground in a ditch or swale and including two legs and a central section, each leg being located adjacent to the front face of one body, and into the ground and said central section being positioned between the bodies and located adjacent to the rear faces of the bodies.

11. The ditch check defined in claim 10 further including a water-permeable cover on the front face of each body, the cover on one body being different from the cover on the other body, each cover having one portion located adjacent to the bottom of the body associated therewith, said one portion extending away from said associated body.

12. The ditch check defined in claim 10 further including a tool for placing said M-shaped anchor means in the ground, said tool comprising a U-shaped body having V-shaped legs for accommodating the legs of said anchor means, and a bight section connecting the legs of said tool together, a driver section located on said bight section and having a driver head on a top end thereof and a body section connecting said head to said bight section whereby impacts delivered to said head are transferred to the legs of said tool via said bight section for driving the M-shaped anchor means into the ground.

13. A tool for placing anchor means in a ditch check comprising a U-shaped body having V-shaped legs for accommodating an M-shaped anchor, and a bight section connecting said legs together, a driver section located on said bight section and having a driver head on a top end thereof and a body section connecting said head to said bight section whereby impacts delivered to said head are transferred to said legs via said bight section for driving the M-shaped anchor into the ground.

* * * * *